US009879860B2

(12) United States Patent
Mori

(10) Patent No.: US 9,879,860 B2
(45) Date of Patent: Jan. 30, 2018

(54) FLAME DETECTING SYSTEM

(71) Applicant: Azbil Corporation, Tokyo (JP)

(72) Inventor: Raita Mori, Tokyo (JP)

(73) Assignee: Azbil Corporation, Tokyo (JP)

( * ) Notice: Subject to any disclaimer, the term of this patent is extended or adjusted under 35 U.S.C. 154(b) by 29 days.

(21) Appl. No.: 15/164,261

(22) Filed: May 25, 2016

(65) Prior Publication Data

US 2016/0348906 A1 Dec. 1, 2016

(30) Foreign Application Priority Data

May 26, 2015 (JP) ..... 2015-106034

(51) Int. Cl.
*F23N 5/08* (2006.01)

(52) U.S. Cl.
CPC ..... *F23N 5/082* (2013.01); *F23N 2029/00* (2013.01)

(58) Field of Classification Search
CPC ..... F23N 5/082; F23N 2029/00
USPC ..... 250/372
See application file for complete search history.

(56) References Cited

FOREIGN PATENT DOCUMENTS

JP H05-157627 A 6/1993
JP H6-076184 A 3/1994
JP 2004-041843 A 2/2004
JP 2011-141290 A 7/2011
JP 2013-171560 A 9/2013

OTHER PUBLICATIONS

Japanese Application No. JP2015-106034, filed May 26, 2015.
Korean Intellectual Property Office, "Office Action", issued in Korean Patent Application No. 10/2016-0061924 which is a KR counterpart of U.S. Appl. No. 15/164,261, dated Sep. 8, 2017, 7 pages (3 pages of English Translation of Office Action and 4 pages of Office Action).

*Primary Examiner* — David Porta
*Assistant Examiner* — Gisselle Gutierrez
(74) *Attorney, Agent, or Firm* — Amster Rothstein & Ebenstein LLP

(57) ABSTRACT

A flame detecting system includes a flame sensor to detect light and a calculating device, in which the calculating device includes an applied voltage generating portion configured to generate a pulse to drive the flame sensor, a voltage detecting portion configured to measure an electric signal flowing in the flame sensor, a storing portion configured to store sensitivity parameters of the flame sensor in advance, and a central processing unit configured to obtain a quantity of received light of flame using parameters of a known quantity of received light, a pulse width, and a discharge probability of the sensitivity parameters, and a discharge probability obtained from an actual pulse width and the measured number of discharge times, and in which a difference in sensitivity of individual flame sensors is corrected from sensitivity parameters related to a first flame sensor and sensitivity parameters related to a second flame sensor.

3 Claims, 4 Drawing Sheets

FLAME DETECTING SYSTEM

CROSS-REFERENCE TO RELATED APPLICATION

This application claims the benefit of and priority to Japanese Patent Application No. 2015-106034, filed on May 26, 2015, the entire contents of which are incorporated by reference herein.

TECHNICAL FIELD

The present invention is related to a flame detecting system that detects the presence or absence of a flame.

BACKGROUND ART

Conventionally, an electron tube which is used for detecting the presence or absence of a flame on the basis of ultraviolet rays emitted from the flame in a combustion furnace or the like has been known. The electron tube includes a sealed container which is sealed and filled with predetermined gas, an electrode supporting pin that penetrates through the sealed container, and two electrodes that are supported in parallel with each other by the electrode supporting pin within the sealed container. In the electron tube, when one electrode arranged to oppose the flame is irradiated with ultraviolet rays in a state where a predetermined voltage is applied across the electrodes through the electrode supporting pin, electrons are emitted from the one electrode due to the photoelectric effect and excited in succession one after another to cause an electron avalanche between the one electrode and the other electrode. Therefore, it is possible to detect the presence or absence of a flame by measuring a change in impedance between electrodes, a change in voltage between electrodes, and electric current flowing between electrodes. Various methods for detecting the presence or absence of a flame have been suggested.

In the related art, there has been suggested a method in which electric current flowing between electrodes is integrated and it is determined that a flame is present in a case where an integrated value is greater than or equal to a predetermined threshold value and a flame is absent in a case where the integrated value is less than the predetermined threshold value (for example, see PTL 1).

The invention of PTL 2 has an object to provide a flame detecting device capable of reliably detecting a flame to be detected at all times regardless of a change in ambient light such as sunlight. In PTL 2, the flame detecting device detects illuminance of ambient light such as sunlight and automatically adjusts detection sensitivity of ultraviolet rays emitted by a flame in accordance with the detected illuminance such that the flame is reliably detected regardless of a change in ambient light. The flame detecting device copes with a change in a surrounding environment.

CITATION LIST

Patent Literature

[PTL 1] JP-A-2011-141290
[PTL 2] JP-A-6-76184

SUMMARY OF THE INVENTION

Problem that the Invention is to Solve

However, a flame sensor itself is a product having a lifespan and needs to be replaced appropriately. On the other hand, the flame sensor has an individual difference in sensitivity. For that reason, in a case where a client replaces a flame detecting sensor, there is a problem that a case exists where outputs of flame detecting sensors are different even for an equivalent flame.

In order to solve the problem, the present invention corrects a difference in sensitivity of individual flame sensors (UV tube) with respect to the same flame signal using sensitivity parameters of at least two flame sensors.

Means for Solving the Problem

According to the present invention, a flame detecting system comprising a flame sensor to detect light and a calculating device is provided. In the flame detecting system, the calculating device includes an applied voltage generating portion configured to generate a pulse to drive the flame sensor, a voltage detecting portion configured to measure an electric signal flowing in the flame sensor, a storing portion configured to store sensitivity parameters provided in the flame sensor in advance, and a central processing unit configured to obtain a quantity of received light of aflame using parameters of a known quantity of received light, a pulse width, and a discharge probability of the sensitivity parameters, and a discharge probability obtained from an actual pulse width and the measured number of discharge times. In the flame detecting system, the central processing unit obtains quantities of received light respectively from sensitivity parameters related to a first flame sensor and sensitivity parameters related to a second flame sensor, computes a ratio of the quantities of received light, and corrects a difference in sensitivity of individual flame sensors.

Furthermore, according to the present invention, in the flame detecting system, using the ratio of the quantities of received light, a presence or absence of flame determination threshold related to the first flame sensor may be multiplied by the ratio of the quantities of received light and a value obtained by the multiplication may be used for a presence or absence of flame determination threshold related to the second flame sensor.

According to the present invention, in the flame detecting system, a pulse width ratio may be calculated instead of the ratio of the quantities of received light, a pulse width related to the first flame sensor may be multiplied by the calculated pulse width ratio, and a value obtained by the multiplication may be used for a pulse width related to the second flame sensor.

Advantage of the Invention

According to the present invention, a ratio of quantities of received light can be obtained with computation by a digital calculation using a known parameter group related to two flame sensors stored in advance, an actual operating quantity and a measurement amount and thus, an effect that a difference in sensitivity of individual sensors is corrected easily and rapidly is obtained.

Figure 1:
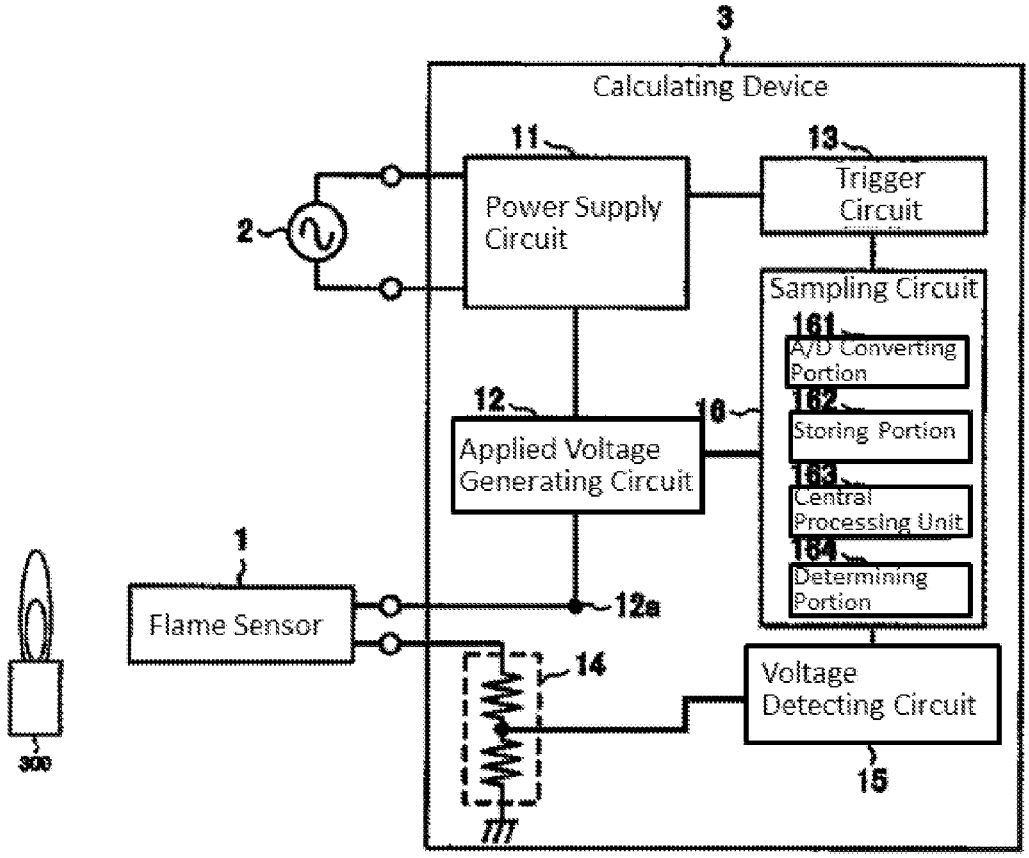
FIG. 1 illustrates a flame detecting system according to an embodiment of the present invention.

MODE FOR CARRYING OUT THE INVENTION (1) Configuration of the Present Invention A flame detecting system according to an embodiment of the present invention is illustrated in FIG. 1 and the configuration thereof will be described. The flame detecting system according to the present embodiment includes a flame sensor 1, an external power supply 2, and a calculating device 3 to which the flame sensor 1 and the external power supply 2 are connected.

The flame sensor 1 is configured by an electron tube including a cylindrical envelope of which both ends are closed, an electrode pin that penetrates through the envelope, and two electrodes that are supported in parallel with each other by the electrode pin within the envelope. In such an electron tube, the electrodes are arranged to oppose a device, such as a burner, which generates a flame 300. With this, when the electrodes are irradiated with ultraviolet rays in a state where a predetermined voltage is applied across the electrodes, electrons are emitted from one electrode due to the photoelectric effect and excited in succession one after another to cause an electron avalanche between the one electrode and the other electrode. With this, a voltage, electric current, and impedance between the electrodes are changed.

The external power supply 2 is configured by a commercial AC power supply having a voltage value of, for example, 100 [V] or 200 [V].

The calculating device 3 includes a power supply circuit 11 connected to the external power supply 2, an applied voltage generating circuit 12 and a trigger circuit 13 that are connected to the power supply circuit 11, an output terminal 12*a* of the applied voltage generating circuit 12, a voltage dividing resistor 14 connected to an electrode pin of a downstream side of the flame sensor 1, a voltage detecting circuit 15 connected to the voltage dividing resistor 14, and a sampling circuit 16 to which the voltage detecting circuit 15 and the trigger circuit 13 are connected.

The power supply circuit 11 supplies the AC power received from the external power supply 2 to the applied voltage generating circuit 12 and the trigger circuit 13 and acquires power for driving the calculating device 3.

The applied voltage generating circuit 12 boosts the AC voltage applied by the power supply circuit 11 to a predetermined value and applies the AC voltage to the flame sensor 1. In the present embodiment, a pulsed voltage of 400 [V] is applied to the flame sensor 1.

The trigger circuit 13 detects a predetermined value point of the AC voltage applied by the power supply circuit 11 and inputs the detected result to the sampling circuit 16. In the present embodiment, the trigger circuit 13 detects a minimum value point at which a voltage value becomes a minimum value. In this manner, a predetermined value point regarding an AC voltage is detected and thus, it is possible to detect one cycle of the AC voltage.

The voltage dividing resistor 14 generates a reference voltage from a terminal voltage of the downstream side of the flame sensor 1 and inputs the reference voltage to the voltage detecting circuit 15. The terminal voltage of the flame sensor 1 is a high voltage of 400 [V] as described above and thus, if the terminal voltage is input to the voltage detecting circuit 15 as it is, a heavy load is imposed on the voltage detecting circuit 15. In the present embodiment, the presence or absence of the flame is determined not on the basis of an actual value of the voltage between the terminals of the flame sensor 1 but on the basis of the temporal change of the terminal voltage of the flame sensor 1, that is, a shape of a pulse waveform of the voltage value between the terminals for each unit time. Accordingly, by the voltage dividing resistor 14, the reference voltage in which the change in the voltage between the terminals of the flame sensor 1 is represented, and having a lower voltage value is generated, and the reference voltage is input to the voltage detecting circuit 15.

The voltage detecting circuit 15 detects the voltage value of the reference voltage input from the voltage dividing resistor 14 and inputs the voltage value to the sampling circuit 16.

The sampling circuit 16 determines the presence or absence of the flame on the basis of the voltage value of the reference voltage input from the voltage detecting circuit 15 and a triggering time point input from the trigger circuit 13. In a case where flames occur and thus the flame sensor 1 is irradiated with ultraviolet rays, the electrodes are irradiated with ultraviolet rays and electrons are emitted from one electrode due to the photoelectric effect and the electrons are excited in succession one after another to cause an electron avalanche between the one electrode and the other electrode, and electric current abruptly increases due to the electron avalanche such that emission of electrons accompanied by light emission occurs. Accordingly, the sampling circuit 16 obtains the quantity of received light with computation on the basis of the shape of a voltage waveform having such a pulse shape. The sampling circuit 16 includes an A/D converting portion 161 which generates a voltage value and a voltage waveform by performing an A/D conversion on the input reference voltage, a central processing unit 163 which analyzes the voltage value and the voltage waveform generated by the A/D converting portion 161 and performs calculation, which will be described later, and a determining portion 164 that determines the presence or absence of the flame on the basis of the quantity of received light calculated by the central processing unit 163.

(2) Operation of Flame Detection

Next, description will be made on operation of flame detection according to the present embodiment with reference to FIG. 2.

First, the calculating device 3 applies a high voltage to the flame sensor 1 by the applied voltage generating circuit 12. In such a state, the trigger circuit 13 applies a trigger when the AC voltage input to the power supply circuit 11 from the external power supply 2, that is, the value of the voltage applied to the flame sensor 1 by the applied voltage generating circuit 12 rises from the minimum value point.

Figure 2:
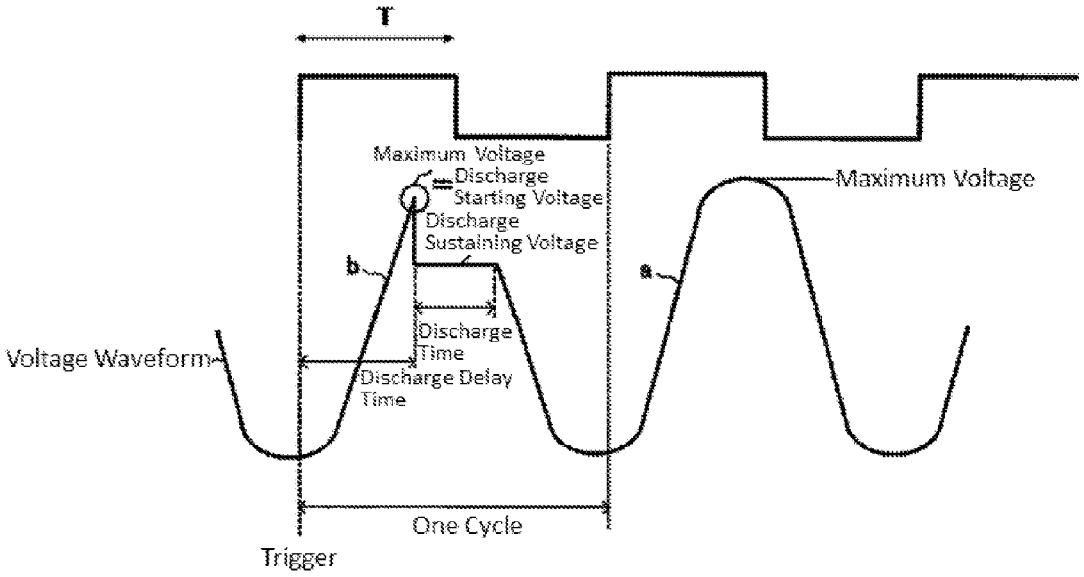
FIG. 2 is a waveform diagram for explaining a discharge waveform.

When the applied voltage passes through the minimum value point, a voltage waveform, which represents the temporal change of the voltage value illustrated in FIG. 2, is applied. As an example, in a case where the voltage value is detected every 0.1 [msec], when a frequency of the external power supply 2 is assumed as 60 [Hz], one cycle is 16.7 [msec] and thus, the voltage values detected for one cycle are 167 samples, and the sampled data is input to the central processing unit 163.

In the present example, in a case where the flame is not occurring, the voltage waveform at terminal 12*a* to be applied to the electrodes of the flame sensor 1 has a gentle shape having a sine wave (hereinafter, referred to as a "normal waveform") as illustrated in a reference symbol a of FIG. 2. On the other hand, in a case where the flame occurs and the flame sensor 1 is irradiated with ultraviolet rays, the voltage waveform has a characteristic shape (hereinafter, referred to as a "discharge waveform") in which the voltage value falls in the vicinity of the positive extreme value, the location where the voltage value has fallen continues for a predetermined time and then, the voltage waveform returns to the sine wave as illustrated in a reference symbol b of FIG. 2. One of the features of the present invention is to regard a state where the maximum voltage is equal to a peak of discharge starting voltage as a single discharge time by the voltage detecting circuit 15. In the meantime, a pulse width to drive the flame sensor 1 is denoted by T in the rectangular pulse illustrated in the upper part of FIG. 2.

In the meantime, it is appropriate for an actual circuit to have a DC circuit configuration and thus, the power supply circuit 11 or the applied voltage generating circuit 12 have an AC to DC converter built therein and the DC output voltage thereof is applied to the flame sensor 1. The discharge probability is obtained in the following sequence.

1. When a rectangular trigger controlled to have a width T is applied to the applied voltage generating circuit 12 from the central processing unit 163, an applying voltage is applied to the flame sensor 1 in synchronization with the trigger.

2. When the flame sensor 1 does not discharge, electric current does not flow in the flame sensor 1 and the voltage dividing resistor 14 of the downstream side of the flame sensor 1 is connected to a ground and thus, the voltage is not generated.

3. When the flame sensor 1 discharges, electric current flows in the flame sensor 1 and a potential difference occurs between both ends of the voltage dividing resistor 14.

4. Whether the voltage has been generated in the downstream side of the flame sensor 1 is detected by the voltage detecting circuit 15.

5. The central processing unit 163 computes the discharge probability using the number of rectangular triggers sent to the applied voltage generating circuit 12 and the number of times that a predetermined voltage is detected by the voltage detecting circuit 15.

(3) Basic Principle of the Present Invention

The flame detecting system which uses the photoelectric effect obtains the quantity of received light according to the following operation principle and thus, the operation principle will be described.

It is considered that a probability that discharge occurs when a single photon collides with a photoelectric sensor is $P_1$ and a probability that discharge occurs when two photons collide with the photoelectric sensor is $P_2$. Since $P_2$ is an inverse of a probability that discharge does not occur when a first photon collides with the photoelectric sensor and also when a second photon collides with the photoelectric sensor, a relationship between $P_1$ and $P_2$ is expressed as Equation 1.

$$(1-P_2)=(1-P_1)^2 \quad \text{[Equation 1]}$$

In general, when a probability that discharge occurs when n photons impinge on the sensor and a probability that discharge occurs when m photons impinge on the sensor are assumed as $P_n$ and $P_m$, respectively, Equation 2 and Equation 3 are established similar to Equation 1.

$$(1-P_n)=(1-P_1)^n \quad \text{[Equation 2]}$$

$$(1-P_m)=(1-P_1)^m \quad \text{[Equation 3]}$$

Equation 4 to Equation 6 are derived from Equation 2 and Equation 3 as a relationship between $P_n$ and $P_m$.

$$(1-P_n)^{\frac{1}{n}} = (1-P_m)^{\frac{1}{m}} \quad \text{[Equation 4]}$$

$$(1-P_n)^{\frac{m}{n}} = (1-P_m) \quad \text{[Equation 5]}$$

$$\frac{m}{n} = \log_{(1-P_n)}(1-P_m) \quad \text{[Equation 6]}$$

When it is assumed that the number of photons incoming to the electrode per unit time is E and a time period during which a voltage greater than or equal to the discharge starting voltage is applied (hereinafter, referred to as a "pulse width") is T, the number of photons that collide with the electrode per each voltage application is represented as E*T.

When the same flame sensor is caused to operate in a certain condition A and another condition B, a relationship among the number of photons E, the time period T, and the probability P is represented by Equation 7. In addition, if the number of photons to be assumed as a reference is set to $E_0$ and $Q=E/E_0$ is set, Equation 8 is derived. Q is referred to as a quantity of received light. The quantities of received light for the condition A and the condition B are $Q_A$ and $Q_B$, respectively.

$$\frac{E_B T_B}{E_A T_A} = \log_{(1-P_A)}(1 \quad P_B) \quad \text{[Equation 7]}$$

$$\frac{Q_B T_B}{Q_A T_A} = \log_{(1-P_A)}(1-P_B) \quad \text{[Equation 8]}$$

EXAMPLE

Next, a flow of the quantity of received light calculation which is a main part of the present invention will be described using operations of the central processing unit 163. The central processing unit 163 is configured by a CPU.

Example 1

Figure 3:
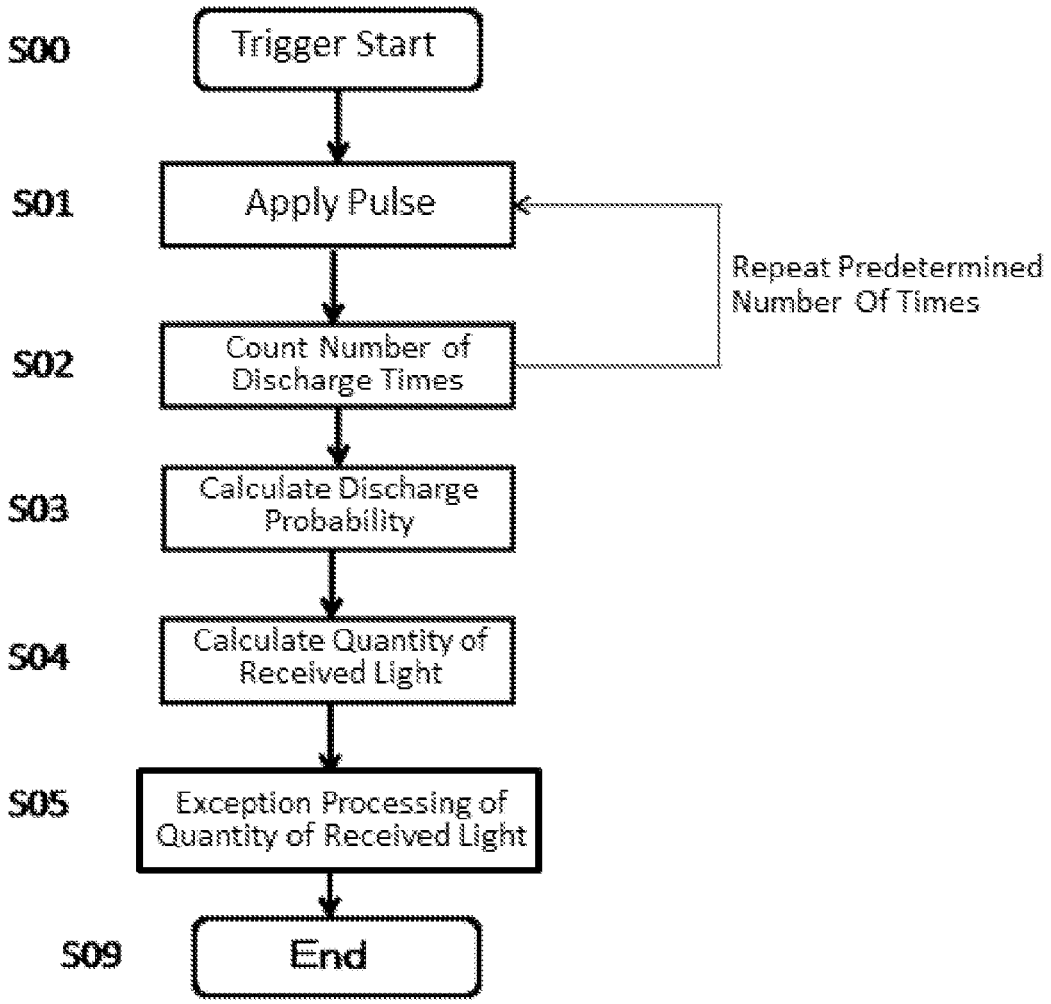
FIG. 3 illustrates a flow of a central processing unit which is a basic portion of implementation of the present invention.

Description will be made on the flow of FIG. 3 (step in the figure is denoted by Snn).

The operations of the central processing unit 163 are formed of steps for driving the flame sensor 1 with a pulse voltage and calculating the quantity of received light for the flame from a driven result of the flame sensor 1.

A predetermined trigger is received and the flow is started (S00).

The flame sensor is driven to operate the applied voltage generating circuit 12 to apply the voltage greater than or equal to the discharge starting voltage to the flame sensor 1 using a rectangular pulse T having a certain width (S01).

The number of discharge times of the flame sensor 1 caused by repeatedly applying the pulse T to the flame sensor 1 for a predetermined number of times is counted by the signal obtained through the voltage detecting circuit 15 (S02).

The discharge probability P is calculated from the number of discharge times and the number of applied pulses (S03).

The quantity of received light is calculated from the discharge probability (S04). In a case where the discharge probability is other than 0 or 1, the quantity of received light is obtained using a digital calculation by the following Equation 10.

In a case where the discharge probability is 0, the quantity of received light is assumed as 0. A case where the discharge probability is 1 is excluded from a target to be calculated (S05).

$$\frac{QT}{Q_0T_0} = \log_{(1-P_0)}(1-P) \quad \text{[Equation 9]}$$

$$Q = \frac{Q_0T_0}{T}\log_{(1-P_0)}(1-P) \quad \text{[Equation 10]}$$

In Equation 9 and Equation 10 described above, it is assumed that a discharge probability $P_0$ based on a quantity of received light $Q_0$ under a certain operation condition and a pulse width $T_0$ under the condition has already been known. The discharge probability is, for example, measured based on the determined quantity of received light and the pulse width in a shipment inspection in the flame sensor 1 and is stored in the storing portion 162.

In this case, the relationship among the quantity of received light Q, the pulse width T, and the discharge probability P is obtained by using Equation 9 and thus, the quantity of received light $Q_0$, the pulse width $T_0$, and the discharge probability $P_0$ are referred to as sensitivity parameters of the flame sensor 1.

The $Q_0$, the $T_0$, and the $P_0$ are already known and have been stored. The pulse width T is a pulse width which is actually output from the applied voltage generating circuit 12 by the central processing unit 163 and thus, the pulse width T is a known number. The pulse is actually applied for a plurality of a number of times and the number of discharge times for the plurality of a number of pulse applying times may be counted to obtain the discharge probability P. Then, the quantity of received light Q which is an unknown number can be uniquely calculated from Equation 10.

Next, the present example will be described in the following. A certain flame sensor assumed as a reference is referred to as α. α may be a flame sensor provided in a flame detecting system before α is replaced, or may be a virtual flame sensor. Also, a flame sensor to be operated in the following is referred to as β. Combinations of a known quantity of received light, a pulse width, and a discharge probability regarding respective flame sensors are assumed as ($Q_{\alpha 0}$, $T_{\alpha 0}$, $P_{\alpha 0}$) and ($Q_{\beta 0}$, $T_{\beta 0}$, $P_{\beta 0}$), respectively. The quantity of received light Q is measured by the flame sensors α and β, and the pulse widths when the discharge probability of each of the flame sensors is P are assumed as $T_\alpha$ and $T_\beta$, respectively.

When the pulse widths and the amount of received light are substituted into Equation 9, Equation 11 and Equation 12 are obtained. Further, Equation 13 to Equation 15 are obtained from Equation 11 and Equation 12.

$$\frac{Q_\alpha T}{Q_{\alpha 0}T_{\alpha 0}} = \log_{(1-P_{\alpha 0})}(1-P) \quad \text{[Equation 11]}$$

$$\frac{Q_\beta T}{Q_{\beta 0}T_{\beta 0}} = \log_{(1-P_{\beta 0})}(1-P) \quad \text{[Equation 12]}$$

$$\frac{Q_\beta T}{Q_\alpha T} \times \frac{Q_{\alpha 0}T_{\alpha 0}}{Q_{\beta 0}T_{\beta 0}} = \frac{\log_{(1-P_{\beta 0})}(1-P)}{\log_{(1-P_{\alpha 0})}(1-P)} \quad \text{[Equation 13]}$$

$$\frac{Q_\beta}{Q_\alpha} = \frac{Q_{\beta 0}T_{\beta 0}}{Q_{\alpha 0}T_{\alpha 0}} \times \frac{\log_{(1-P_{\beta 0})}(1-P)}{\log_{(1-P_{\alpha 0})}(1-P)} \quad \text{[Equation 14]}$$

A base conversion may be performed to obtain Equation 15.

$$\frac{Q_\beta}{Q_\alpha} = \frac{Q_{\beta 0}T_{\beta 0}}{Q_{\alpha 0}T_{\alpha 0}} \times \log_{(1-P_{\beta 0})}(1-P_{\alpha 0}) \quad \text{[Equation 15]}$$

$Q_\beta/Q_\alpha$ obtained in Equation 15 is referred to as a ratio of quantities of received light.

Figure 4:
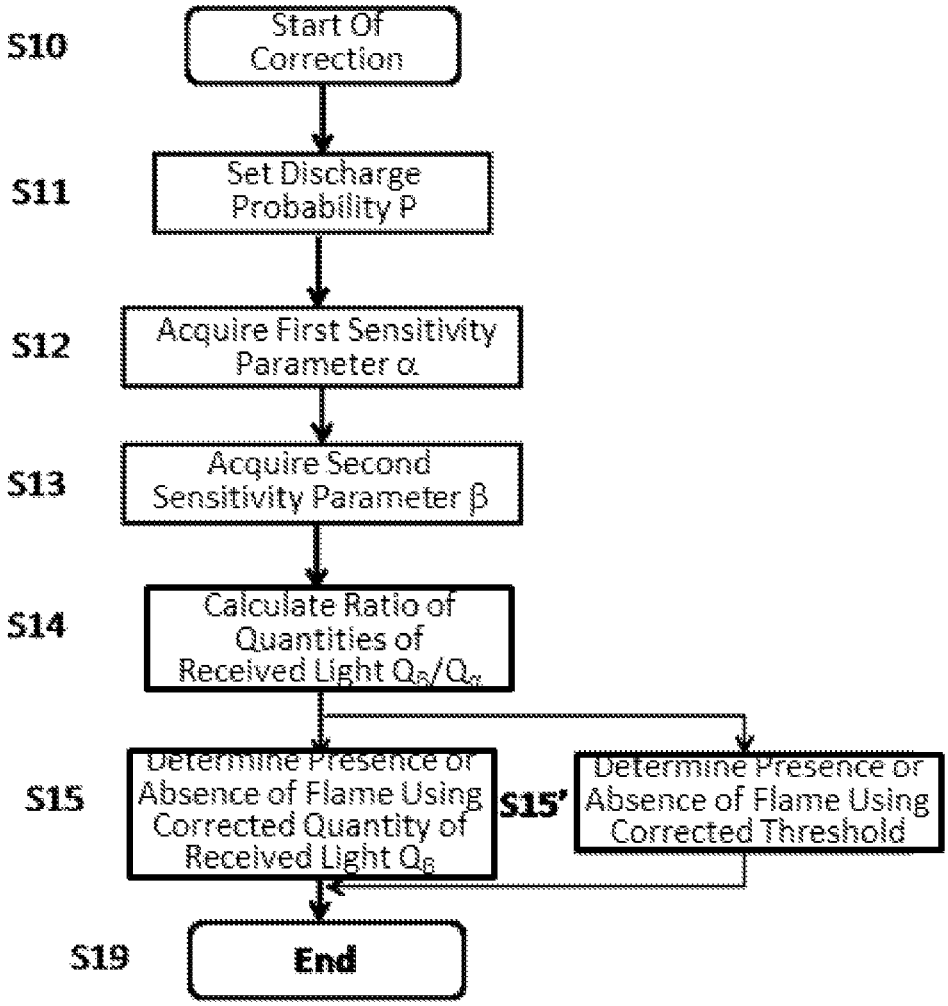
FIG. 4 illustrates a flow of a central processing unit which is an embodied aspect of the present invention.

Steps of correcting a difference in sensitivity of individual flame sensors using the ratio of quantities of received light are described on the basis of a flow of FIG. 4 (step in the figure is denoted by Snn.)

Then, the present adjustment logic operates after calculation processing of the quantity of received light is finished, but if the ratio of the quantities of received light is obtained in advance, it is very efficient. The adjustment logic is also executed by the central processing unit 163 with no change.

The correction processing is started (S10).

A desired discharge probability P intended to be adjusted is set (S11).

The sensitivity parameters of the known quantity of received light Q, the pulse width T, and the discharge probability P related to the first flame sensor α are acquired from the storing portion 162 (S12).

The sensitivity parameters of the known quantity of received light Q, the pulse width T, and the discharge probability P related to the second flame sensor β are acquired from the storing portion 162 (S13).

A ratio of quantities of received light is calculated from the Equation 15 (S14).

The quantity of received light $Q_\beta$, which is calculated from the discharge probability measured when the second flame sensor β is used, is divided by the ratio of quantities of received light (S15).

In this manner, the quantity of received light capable of eliminating the difference in sensitivity of individual flame sensors of two flame sensors is obtained.

Otherwise, when proceeding to a step (S15') where multiplication of the ratio of quantities of received light is performed, as a presence or absence of flame determination threshold, a value which is set by the first flame sensor can be used as it is.

As such, the threshold may be multiplied by $Q_\beta/Q_\alpha$ and if the threshold is for the quantity of received light $Q_\beta$ corrected in the step described above, the previous threshold may be used as it is.

Other Examples

Next, other examples will be described in the following. Also, the quantity of received light Q is measured by the flame sensors α and β, and the pulse widths when the discharge probability of each of the flame sensors is P are assumed as $T_\alpha$ and $T_\beta$, respectively.

This time, the quantity of received light Q is shared by the flame sensors and the pulse width T becomes independent with $T_\alpha$ and $T_\beta$. As a result, Equation 21 and Equation 22 are obtained. Further, Equation 23 to Equation 25 are obtained from Equation 21 and Equation 22.

$$\frac{QT_\alpha}{Q_{\alpha 0}T_{\alpha 0}} = \log_{(1-P_{\alpha 0})}(1-P) \quad \text{[Equation 21]}$$

-continued $$\frac{QT_\beta}{Q_{\beta 0}T_{\beta 0}} = \log_{(1-P_{\beta 0})}(1-P) \quad \text{[Equation 22]}$$

$$\frac{QT_\beta}{QT_\alpha} \times \frac{Q_{\alpha 0}T_{\alpha 0}}{Q_{\beta 0}T_{\beta 0}} = \frac{\log_{(1-P_{\beta 0})}(1-P)}{\log_{(1-P_{\alpha 0})}(1-P)} \quad \text{[Equation 23]}$$

$$\frac{T_\beta}{T_\alpha} = \frac{Q_{\beta 0}T_{\beta 0}}{Q_{\alpha 0}T_{\alpha 0}} \times \frac{\log_{(1-P)}(1-P_{\alpha 0})}{\log_{(1-P)}(1-P_{\beta 0})} \quad \text{[Equation 24]}$$

This is referred to as a pulse width ratio. Equation 24 is further developed and Equation 25 is obtained.

$$T_\beta = T_\alpha \times \frac{Q_{\beta 0}T_{\beta 0}}{Q_{\alpha 0}T_{\alpha 0}} \times \log_{(1-P_{\beta 0})}(1-P_{\alpha 0}) \quad \text{[Equation 25]}$$

The pulse width is set to a value $T_\beta$ indicated in Equation 25 with respect to the flame sensor β and thus, it is possible to obtain the same discharge probability P as the flame sensor a in a case of the same quantity of received light by the flame sensor β. That is, the flame detection result in which sensitivity is corrected is also obtained similarly as in the example described above. The pulse width ratio of Equation 24 is used instead of the ratio of quantities of received light. In the following, the matters described above are also similar as in a software flow and thus, description thereof will not be repeated.

INDUSTRIAL APPLICABILITY

Various modifications can be made. Although not mentioned in the present example, shutter functionality can be provided on the envelope of the flame sensor 1 to be used in a flame detecting system for detection of a pseudo flame.

Such design modification is also included in a scope of the present invention.

DESCRIPTION OF REFERENCE NUMERALS AND SIGNS

1: flame sensor
2: external power supply
3: calculating device
11: power supply circuit
12: applied voltage generating circuit
13: trigger circuit
14: voltage dividing resistor
15: voltage detecting circuit
16: sampling circuit
161: A/D converting portion
162: storing portion
163: central processing unit
164: determining portion
300: burner flame.

The invention claimed is:

1. A flame detecting system comprising:
a flame sensor configured to detect light; and
a calculating device,
wherein the calculating device comprises:
an applied voltage generating portion configured to generate a pulse to drive the flame sensor,
a voltage detecting portion configured to measure an electric signal flowing in the flame sensor,
a storing portion configured to store sensitivity parameters of the flame sensor in advance, and
a central processing unit configured to obtain a quantity of received light of a flame using parameters of a known quantity of received light, a pulse width, and a discharge probability of the sensitivity parameters, and a discharge probability obtained from an actual pulse width and the measured number of discharge times, and
wherein the central processing unit is configured to obtain quantities of received light respectively from sensitivity parameters related to a first flame sensor and sensitivity parameters related to a second flame sensor, compute a ratio of the quantities of received light, and correct a difference in sensitivity of individual flame sensors.

2. The flame detecting system according to claim 1,
wherein using the ratio of the quantities of received light, a presence or absence of flame determination threshold related to the first flame sensor is multiplied by the ratio of the quantities of received light and the value obtained by the multiplication is used for a presence or absence of flame determination threshold related to the second flame sensor.

3. A flame detecting system comprising:
a flame sensor configured to detect light; and
a calculating device,
wherein the calculating device comprises:
an applied voltage generating portion configured to generate a pulse to drive the flame sensor,
a voltage detecting portion configured to measure an electric signal flowing in the flame sensor,
a storing portion configured to store sensitivity parameters of the flame sensor in advance, and
a central processing unit configured to obtain a quantity of received light of a flame using parameters of a known quantity of received light, a pulse width, and a discharge probability of the sensitivity parameters, and a discharge probability obtained from an actual pulse width and the measured number of discharge times, and
wherein the central processing unit is configured to obtain quantities of received light respectively from sensitivity parameters related to a first flame sensor and sensitivity parameters related to a second flame sensor, compute a pulse width ratio based on the obtained quantities of received light of individual flame sensors, and correct a difference in sensitivity of individual flame sensors.

* * * * *